United States Patent [19]

Lavallee

[11] 4,091,366

[45] May 23, 1978

[54] SONIC MONITORING METHOD AND APPARATUS

[75] Inventor: Thomas F. Lavallee, Phoenix, Ariz.

[73] Assignee: J.H. McDaniel Tele-Communications, Inc., Phoenix, Ariz.

[21] Appl. No.: 706,453

[22] Filed: Jul. 19, 1976

[51] Int. Cl.[2] ..... G08B 13/22

[52] U.S. Cl. ..... 340/258 R; 340/224; 340/261

[58] Field of Search ..... 340/224, 261, 258 R, 340/345, 171 PF, 171 A, 147 F

[56] References Cited

U.S. PATENT DOCUMENTS

| | | | |
|---|---|---|---|
| 3,705,401 | 12/1972 | Scott | 340/261 |
| 3,713,125 | 1/1973 | Miller | 340/224 R |
| 3,848,231 | 11/1974 | Wootton | 340/224 |
| 3,864,674 | 2/1975 | Worsham et al. | 340/171 PF |

*Primary Examiner*—Glen R. Swann, III

*Attorney, Agent, or Firm*—Fitch, Even, Tabin & Luedeka

[57] ABSTRACT

A detector is positioned in each of a plurality of protected zones for converting detected sound into electric signals which are amplified and fed to operatively associated discriminators which generate an alarm signal responsive to the detection of electric signals indicative of the occurrence of an alarm condition. Security personnel stationed at locations remote to the zones in which the alarm condition occurred are automatically notified of the occurrence and location of the alarm condition for purposes of taking remedial action. A local annunciator system is provided to notify further security personnel of the occurrence and location of the alarm condition and includes an audio system which is actuated automatically, in the preferred embodiment, responsive to the generation of an alarm signal by one of the discriminators for purposes of continuously monitoring the zone within which the alarm condition occurred to determine the nature of the alarm condition to the end that appropriate remedial action can be taken.

10 Claims, 3 Drawing Figures

SONIC MONITORING METHOD AND APPARATUS

Figure 1:
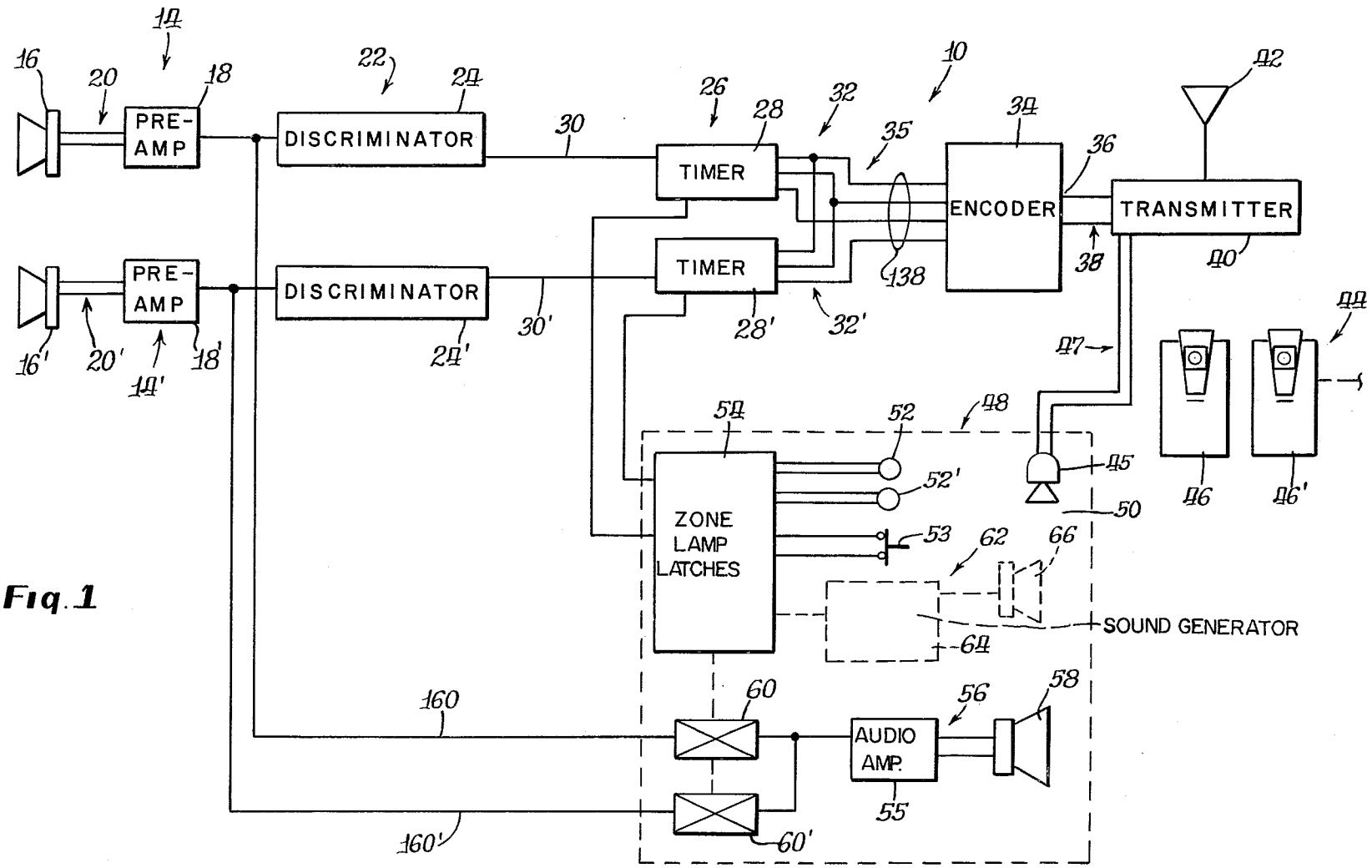

This invention relates to a sonic monitor system and more particularly concerns a system adapted for monitoring the sound level in preselected protected zones from locations remote to such zones and for notifying security personnel of the occurrence and location of an alarm condition.

Certain security systems are used in conjunction with protected areas for monitoring the integrity of preselected zones within such areas to detect alarm conditions which may require further investigation or remedial action. Monitoring systems find particular application in connection with buildings having secluded zones in which experience has shown that unauthorized activity or violence is likely to occur. For example, it has been found that the restrooms of transportation terminals, such as bus stations, are frequently the location of crimes of a violent nature. It is, however, not feasible to station security personnel in such areas because of monetary considerations. Moreover, the continuous monitoring of sound within such areas is prohibited in view of privacy considerations.

Heretofore, monitoring systems have been known which employ detectors positioned at predetermined locations for generating an alarm signal indicative of an unauthorized activity or intrusion desired to be prevented or remedied. In this connection, the detectors positioned in protected zones may be adapted for monitoring a variety of conditions such as temperature, standing electromagnetic wave patterns, sound and the like. Generally, the detectors generate a signal for advising security personnel of the occurrence of an alarm condition within the range of the detector and the alarm condition is thence investigated by available and authorized personnel for purposes of taking remedial action.

Prior art monitoring systems suffer certain disadvantages, however. For example, security personnel may be required to search for the location of the alarm condition being appraised in certain systems, such as systems which generate an audible alarm signal, for example, only that an alarm condition has occurred. In such systems, the nature of the remedial action necessary to allay the alarm condition is indeterminable until security personnel reach the zone of such condition. Moreover, aberrational conditions of an accidental nature may result in the generation of an alarm signal, yet investigatory personnel dispatched to the protected area cannot be advised prior to reaching the location of the detector responsible for generating the alarm, that investigation and remedial action are not required.

It is therefore an object of this invention to provide an improved system for monitoring the sound levels within preselected protected areas. Another object of this invention is to provide an improved method for monitoring the sound levels in such protected areas. It is another object of this invention to provide such a monitor system which transmits a coded message, indicative of the location at which an alarm condition exists to security personnel stationed at locations remote to the protected areas for advising such personnel of the occurrence and location of the alarm condition. It is a further object of this invention to provide such a system including a local annunciator system for further monitoring the location of an alarm condition to assist in determining what remedial action, if any, is advisable. A still further object of this invention is to provide means for providing security personnel dispatched to the zones of the alarm condition with additional information pertinent to the type of remedial action, if any, necessary.

Figure 2A:
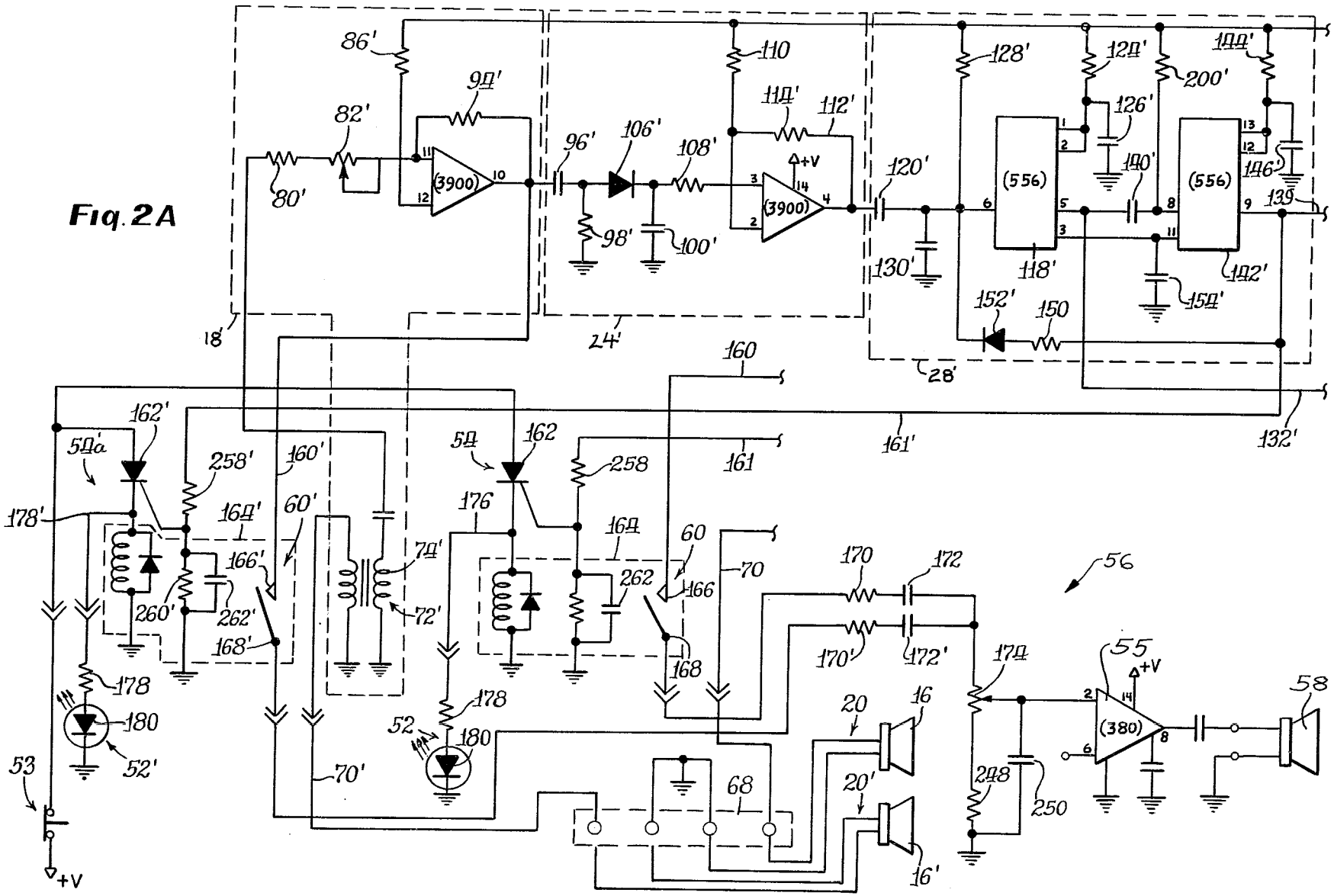
Figure 2B:
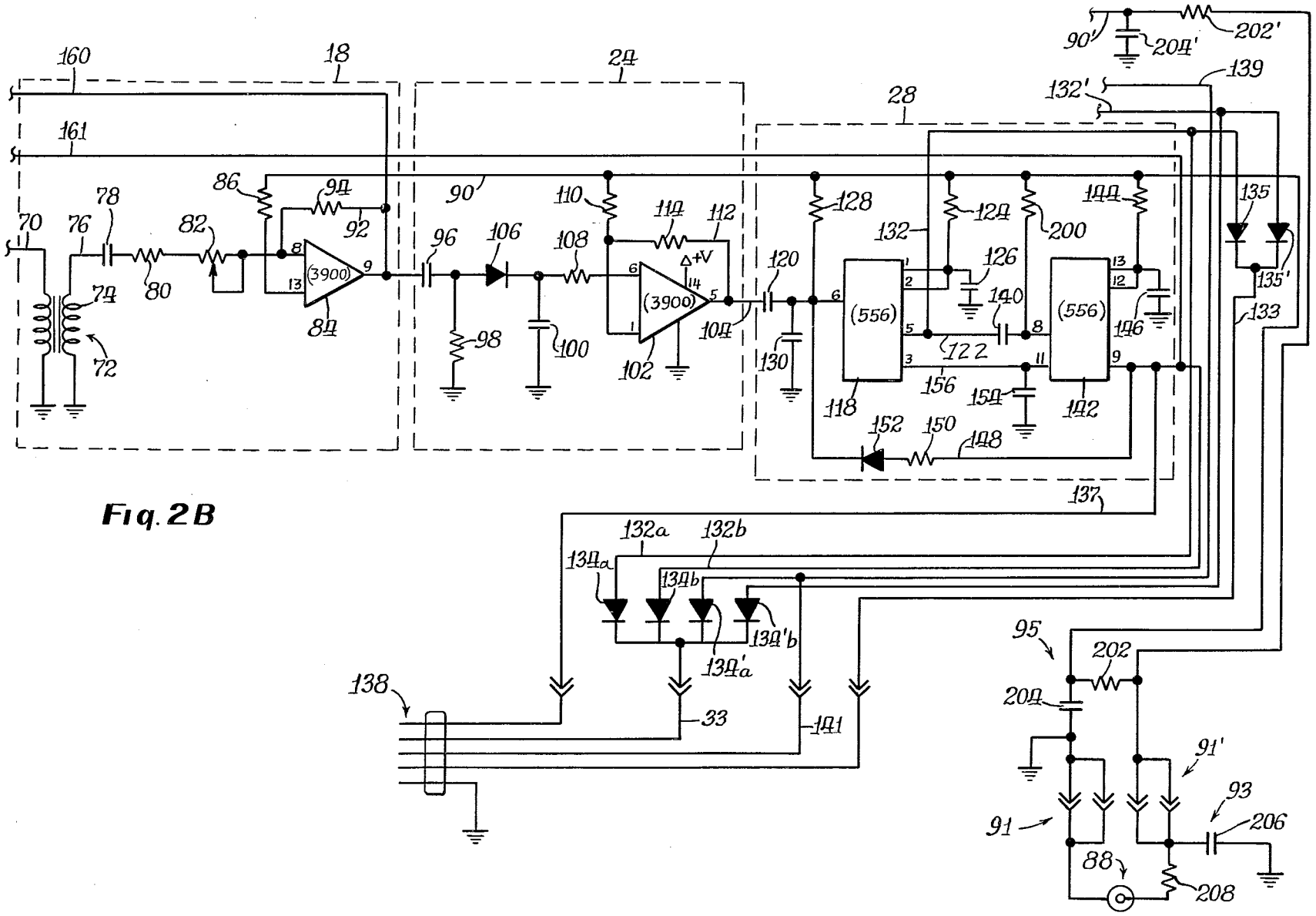

Other objects and advantages will become apparent upon reading the following detailed description, with reference to the attached drawings, wherein:

FIG. 1 is a block diagram of a sonic monitoring system showing various features of the invention; and FIGS. 2A and 2B are a circuit diagram for various of the components of the system shown in FIG. 1.

In accordance with the detailed description, an improved method and apparatus are provided for monitoring the sound level within preselected protected zones to determine the existence and location of an alarm condition which may require remedial action by security personnel. The apparatus comprises sonic detectors positioned in preselected zones for receiving sound generated within such zones and converting the sound into electric signals which are amplified and fed to respective discriminators which generate an alarm signal responsive to the power of the amplified electric signals exceeding a predetermined level which is indicative of the occurrence of an alarm condition. The alarm signal is fed to a timing circuit which produces predetermined timing signals responsive to the generation of an alarm signal. An encoder converts the timing signals into coded combinations of output signals which identify the zone in which the detector receiving sound above a predetermined level is located. A transmitter is connected to the encoder for modulating the coded combination of signals on a carrier signal which is transmitted to locations remote to the detectors for being received by at least one paging receiver tuned for receiving a particular transmitted signal. The paging receivers are preferably carried by security personnel and generate an alert signal responsive to receiving a transmitted signal which indicates the occurrence and location of an alarm condition thereby dispatching security personnel to the location of the alarm condition. Moreover, the alarm signals are fed to a local annunciator system to provide further security personnel with information about the alarm condition. In this connection, the local annunciator system includes suitable indicator means such as zone lamps which are actuated responsive to the generation of an alarm signal to advise the annunciator system operator of the location of an alarm condition. To further define the nature of the alarm condition a sound system which is connected to each of the detectors is actuated for directly monitoring the sound within the zone of the alarm condition to the end that appropriate remedial action can be taken. In one embodiment, a communication path is provided between the local annunciator system and each of the receivers to enable personnel stationed at the annunciator system to provide security personnel alerted by one of the receivers with information pertinent to the type of remedial action, if any, advisable.

The method of the present invention generally includes monitoring the sonic levels within protected zones by detecting sound occurring in the zones with sonic detectors. The sound is converted into electric signals having a power level, or power level determinant, which is proportional to the intensity of the sound detected. The electric signals are amplified by an amplifier connected to the detectors. A discrimination is made among the various amplified signals to determine which signals are indicative of receiving sound above a predetermined level. An alarm signal is generated responsive to the detection of an electric signal indicative of receiving sound in one of the protected zones above a predetermined level. Predetermined timing signals are produced responsive to the generation of the alarm signal and the timing signals are thence fed along predetermined electrical paths to an encoder. The timing signals are encoded at the encoder to produce a coded combination of signals identifying the zone in which the detector receiving sound above a predetermined level is located. The coded combination of signals are modulated on a carrier signal which is transmitted by a suitable transmitter into locations remote to the detectors. Paging receivers generate an alert signal to notify appropriate security personnel of the occurrence and location of an alarm condition responsive to receiving a carrier signal modulated by a coded combination of signals to which a particular paging receiver is tuned.

To assist in preventing the occurrence of an alarm condition from going unnoticed further indication of the generation of an alarm signal is provided at a local annunciator system which produces a further alert signal at a control panel indicating the zone of the occurrence of the alarm condition. In one embodiment respective zone lamps are energized responsive to the generation of an alarm signal to advise the operator of the annunciator system of the location of said zone. Moreover, the zone of the alarm condition is monitored through a sound system actuated responsive to the generation of an alarm signal to gather additional information regarding the nature of the alarm condition to assist in determining what, if any, remedial action is advisable. In one embodiment, a communication path is provided between the local annunciator system and the remote receivers to the end that security personnel alerted by one of the receivers can be advised of the nature of the alarm condition.

Suitable apparatus for carrying out the method of the invention is shown in the Figures.

Referring now to the drawings, a system for monitoring the sound in preselected protected zones constructed in accordance with various features of the invention is indicated generally at 10 in FIG. 1. The illustrated system finds particular application in connection with monitoring buildings having secluded zones such as restrooms in bus terminals, for example, in which experience has shown the likelihood of an occurrence of violence or other unauthorized activities commonly attended by an increase in the sound level or intensity at the location of such occurrence.

The embodiment illustrated in FIG. 1 incorporates two channels 14 and 14' which are adapted for monitoring protected zones at spaced locations in a building, for example. In this connection, sonic detectors 16 and 16' operatively associated with the channels 14 and 14', respectively, are positioned in preselected zones which are desired to be protected from unauthorized activity such as violence. It will be recognized, however, that as necessary or desired to increase the capacity of the system for monitoring additional protected zones additional channels can be added. More specifically, detectors 16 and 16' are adapted for detecting sound generated within range of the detectors and are mounted in a suitable protective housing (not shown) which assist in preventing tampering with the detectors. Moreover, the detector housings are adapted for being positioned on a shelf or secured to a wall as necessary or desired to further assist in preventing tampering by placing the detectors in inconspicuous locations.

The illustrated detectors 16 and 16' are of conventional design and convert detected sound generated within their respective zones of protection into electric signals having a power level, or a power determinant, proportioned to the intensity of the detected sound.

The detectors 16 and 16' are connected at their respective outputs to preamplifiers 18 and 18' through the lead pairs 20 and 20', respectively. Preamplifiers 18 and 18' are operable over the range of frequencies generated by the detector and serve to amplify the electric signals generated by the detector 16 and 16', respectively, to a level sufficient to drive the components connected at the outputs of the amplifiers. Moreover, in the preferred embodiment, the amplifiers 18 and 18' serve to provide a sensitivity control for each of the detector channels 14 and 14' to the end that normal background noise or slight aberrations therefrom are not attended by the generation of false alarms.

To discriminate among the electric signals amplified by the preamplifier 18 and 18' for determining which of the signals are indicative of the sound level in one of the zones exceeding a predetermined level, discriminator means generally indicated at 22 is provided. The illustrated discriminator means 22 comprises discriminators 24 and 24' serially connected at their inputs with the outputs of the preamplifiers 18 and 18', respectively. When the signal level at one of the inputs of the discriminators 24 and 24', respectively, is exceeded, an alarm signal is generated at the output of such discriminator for alerting security personnel of the occurrence of an alarm condition within one of the protected zones. In the preferred embodiment, the level of the signal required for triggering the discriminators 24 and 24' is determined by controlling the sensitivity of the preamplifiers 18 and 18', respectively, as will be described in greater detail hereinafter. The sensitivity of each channel is adjusted to compensate for ambient conditions to assist in preventing the generation of false alarms which are normally attended by calling security personnel from their regularly assigned stations for investigating the zone in which the detected sound exceeded a predetermined level. More specifically, the sensitivity of the respective channels 14 and 14' can be adjusted so that laughing, operation of towel dispensers and the like do not generate an alarm signal. On the other hand, extremely loud sounds such as a gunshot or scream detected by one or both of the detectors 16 and 16' will result in calling appropriate security personnel to the location of the alarm condition.

To assist in generating a signal indicative of the detector at which sound exceeds a predetermined level for notifying security personnel of the occurrence and location of an alarm condition, timing means generally indicated at 26 are provided. The illustrated timing means 26 comprises timing circuits 28 and 28' which are connected with the outputs of the discriminators 24 and 24', respectively, through leads 30 and 30'. Upon alarm signals generated by the discriminators 24 and 24' being fed to the timing circuits 28 and 28', the timing circuits generate timing signals at their respective outputs 32 and 32' which assist in identifying the location of the occurrence of an alarm condition. In the preferred embodiment, the timing signals comprise a predetermined combination of signals which are sequentially generated for duration sufficient to activate remote receivers.

Predetermined signals generated by the timing circuits 28 and 28' are fed through the multiple leads connected at their outputs 32 and 32', respectively, to a common encoder 34 which serves to encode the timing signals generated by the timing circuits 28 and 28' and to identify the zone of the occurrence of an alarm condition for purposes of activating an appropriate receiver carried by security personnel at a remote location. In this connection, the multiple leads generally indicated at 35 comprise predetermined electrical paths which are connected to the encoder 34 for sequentially generating a coded combination of signals at its outputs 36 which identifies one of the detector zones. The encoder 34 is of conventional design and selectively generates one or more tones, in the illustrated embodiment in accordance with predetermined information. One suitable encoder is the Fanon VEN-20 encoder which has a twenty channel capability. In this unit encoding is accomplished by sequentially keying two audio tones between 700 and 1400 Hz. Other suitable encoding means may be substituted as necessary or desired.

The encoder 34 is connected at its output 36 through leads generally indicated at 38 to transmitter 40 which serves to modulate the coded combination of signals generated by the encoder 34 on a carrier signal transmitted from antenna 42 to remote locations. More specifically, tones generated by the encoder 34 in the illustrated embodiment are modulated on a carrier signal to form a tone-coded signal which is indicative of the detector receiving sound above a predetermined level. One suitable transmitter is the Fanon TXVP Model 201 transmitter having an operating frequency of 27.255 MHz and an automatic modulation control.

Coded signals broadcast by the transmitter 40 are received by one of the receivers generally indicated at 44 and carried by respective security personnel who are instructed to proceed to a predetermined protected zone responsive to the receiver carried by them being called. In this connection, each of the receivers 46 and 46' is operable over a common radio carrier frequency and accessed by the tones modulated on the carrier frequency and transmitted by the transmitter 40. The tone access permits the paging of a specific remote receiver responsive to one of the detectors 16 or 16' receiving sound above a predetermined level. In the illustrated embodiment, tone access is accomplished by the generation of two specified tones which are transmitted in a sequence determined by the timing circuits and relayed to the encoder 34. It will be recognized that additional tones may be added as necessary or desired to increase the capacity of the system to uniquely identify one of the protected zones.

In order to provide an ancillary indication of an alarm condition to assist in preventing such condition from going unnoticed as may be occasioned by a malfunction of a remote receiver, for example, a local annunciator system generally indicated at 48 is provided. The illustrated annunciator 48 system is operated by authorized security or supervisory personnel and comprises a control panel 50 which includes indicator means which in one embodiment comprises zone lamps 52 and 52' operatively associated with channels 14 and 14', respectively. In this connection, zone lamps 52 and 52' are connected to timing circuits 28 and 28', respectively, and are energized upon the generation of an alarm signal by the discriminators 24 and/or 24'. The illustrated zone lamps 52 and 52' are connected to the timing circuits through zone lamp latches generally indicated at 54 which serve to maintain the zone lamps 52 and 52' in an actuated, i.e., illuminated condition, responsive to generation of an alarm signal until the latches are reset by supervisory personnel. To this end, supervisory personnel stationed at the control panel 50 are advised of the occurrence and location of an alarm condition.

Responsive to the illumination of a zone lamp, an audio system generally indicated at 56 is actuated in the illustrated embodiment to enable supervisory personnel stationed at the control panel 50 to make a positive verification as to the nature of the alarm condition. In this connection, an audio amplifier 55 of conventional design drives a conventional speaker 58 connected at the output of the amplifier 55. This amplifier 55 is connected to the outputs of the preamplifiers 18 and 18' through switches 60 and 60' which in the preferred embodiment are automatically operated for continuously monitoring the sound within the protected zones associated with the detectors 16 and 16', respectively. Employment of the audio system generally indicated at 56 in conjunction with the lamps 52 and 52' enables continuous monitoring of the protected zones subsequent to the occurrence of an alarm condition. In this connection, the local annunciator system illustrated assists in preventing invasion of privacy of personnel within the protected zones except upon the occurrence of an alarm condition. Moreover, by continuously monitoring the sound received in the protected zones subsequent to the generation of an alarm signal, information can be gathered regarding the nature of the alarm condition to assist security personnel in determining what, if any, remedial action is advisable.

In order to provide security personnel alerted by the paging receivers with additional information concerning the nature of the alarm condition, a communication path is provided between the transmitter 40 and each of the paging receivers 46 and 46'. In this connection, a microphone 45 is positioned at the control panel 50 and connected to the transmitter 40 by lead pair 47. Audio signals produced by the microphone 45 are modulated onto the carrier signal generated by transmitter 40 and transmitted to at least one of the receivers 44 which receives the modulated carrier signal and provides a voice command to security personnel dispatched to the zone of the alarm condition by the receiver alert signal. The Fanon transmitter and receivers mentioned hereinabove are adapted to provide such a communication path. By providing a direct communication path between the local annunciator system and the security personnel carrying the receivers, investigatory steps can be aborted in the event further monitoring the zone of the alarm condition indicates the occurrence of a false alarm such as may be attended by turning over a waste can, for example. Moreover, the personnel dispatched to the zone of the alarm condition can be advised of what remedial actions are advisable.

After the nature of the alarm condition has been determined by continuously monitoring the zone in which the detector receiving sound above a predetermined level is located, the zone lamps and audio system 56 can be de-energized by operation of the reset switch 53. In this connection, the switches 60 and 60' which are automatically placed in an on position responsive to the generation of an alarm signal are returned to their off position.

In certain areas it may be unnecessary or illegal to provide means for directly monitoring the protected zones. In this connection, the audio system 56 is substituted with an alert system 62 adapted for generating an audible alarm tone upon the occurrence of an alarm condition. The illustrated alert system 62 is connected to the timing circuits 28 and 28' through the latches 54 which serve to maintain the alert system 62 in its on condition responsive to the generation of an alarm signal at the output of one of the discriminators 24 and 24'. More specifically, the alert system 62 comprises a sound generator 64 which produces a loud tone at speaker 66 responsive to feeding an alarm signal into the input of the generator 64. The tone which alerts security personnel of the occurrence of an alarm condition continues until the system 52 is silenced by operation of the reset switch 53. One suitable alert system is a solid state piezoelectric sounding device manufactured by Mallory Corporation and identified as part number SC628.

The monitoring system embodying the present invention will now be described in greater detail in conjunction with the more detailed circuit schematic diagrams shown in FIGS. 2A and 2B. Certain of the specific circuits previously described with respect to the block diagram of FIG. 1 are well known and are of conventional design, and for that reason, a detailed explanation of these circuits is not included herein. Thus, a detailed description of the circuit components and operation of the encoder, the transmitter, and the receivers will not be included. Moreover, the circuitry shown in FIGS. 2A and 2B also includes several integrated circuits that are illustrated in block form rather than showing the detailed circuitry that is contained therein. However, the standard industry designation numbers, together with the pin numbers of the integrated circuits are shown in parentheses adjacent or inside the blocks, and the detailed circuits for these block diagrammatic representations are hereby incorporated by a reference herein.

Channels 14 and 14' are substantially identical in operation and description and for this reason a detail of one channel suffices for a description of each channel. Differences between the channels, such as at the interface between the timing circuits and the encoder, are however described in greater detail.

Referring now to FIGS. 2A and 2B, and more specifically to channel 14, sounds received by the detector 16 are converted into electric signals and fed into a suitable housing (not shown) carrying various of the components of the system through a terminal block 68 along lead pairs 20. As necessary or desired to increase the capacity of the system, terminal block 68 may be adapted to accommodate additional detectors.

The electric signals fed into the terminal block 68 from the detector 16 continue along lead 70 (see FIGS. 2A and 2B) to the transformer 72 which serves to match the input from the detectors and steps up the voltage of the signals generated by the detector 16. The secondary 74 of the transformer 72 is connected at one terminal to ground and connected at its opposite terminal by lead 76 to the preamplifier 18 through a coupling capacitor 78. Resistors 80 and 82 serve as the input resistors for the preamplifier 18 and resistor 82 is variable to adjust the input current level of the amplifier 18 for purposes of controlling the sensitivity of channel 14. In the preferred embodiment, the amplifier chip 84 comprises a Norton amplifier and the biasing of the preamplifier 18 is accomplished by resistor 86 which is connected to a common supply generally indicated at 88 through lead 90. A feedback path is provided by lead 92 through resistor 94 which connects the input and output of the amplifier chip 84.

The output of the preamplifier 18 is fed into the input of the discriminator 24 through a capacitor 96 which serves to provide direct current blocking between these stages and resistor 98 is connected as a discharge path for capacitor 96. The audio signal fed into the discriminator 24 charges capacitor 100 which serves as the integrator of the system and charges to a predetermined level controlled by adjusting the sensitivity of the preamplifier 18 with the variable resistance 82. More specifically, the discriminator 24 includes an amplifier 102, which is a Norton amplifier in the preferred embodiment, that switches its output 104 from a quiescent high state to a low state when the input of the amplifier 102 exceeds a predetermined value set by the sensitivity controlled by resistor 82. Diode 106 allows the signal fed into the discriminator from the amplifier 18 to charge the capacitor 100 without bleeding back into the resistor 98. The input resistance of the amplifier 102 is very high in the preferred embodiment and in this connection the only discharge path for the capacitor 100 is the input leakage of the amplifier 102 through the input resistor 108 and the leakage of the capacitor 100 itself.

The amplifier 102 serves as a trigger amplifier to generate an alarm signal at its output 104 responsive to the input of the amplifier exceeding a predetermined level. More specifically, the alarm signal is generated upon switching the output of the amplifier 102 from its quiescent high state to a low state. Resistor 110 sets the biasing level of the amplifier 102 and a feedback path for the amplifier 102 is provided through lead 112 which connects the output of the amplifier with its input through resistor 114.

In order to selectively control the operation of the encoder 34 and the transmitter 40 (See FIG. 1) in connection with generating an alert signal at a predetermined receiver, timing circuit 28 is provided. More specifically, the output of the discriminator 24 is coupled to the input of timer 118 which serves as a "tone 1" timing generator by capacitor 120 which supplies sufficient charge at the input of the timer 118 upon the generation of an alarm signal, i.e., switching the output of the discriminator from a quiescent high state to a low state, to cause triggering of the timer 118. Upon triggering the tone 1 generator, its output 122 goes high for a predetermined period, set at approximately one second in the preferred embodiment by a timing network comprising resistor 124 and capacitor 126. The input of the timer 118 is kept at a high normal level by a pull-up resistor 128 connected to the supply 88 through lead 90. Capacitor 130 connected at the input of the generator 118 serves as a quenching capacitor for electrical transients and noise.

The output of the timer 118 is coupled to the input of a second timer 142 which serves as a "tone 2" generator through a coupling capacitor 140. When the timer 118 has completed its timing out period its output at 122 goes low and triggers the timer 142 which times out for a predetermined period. In the preferred embodiment the timing out period of the timer 142 is determined by a timing network comprising resistor 144 and capacitor 146. Capacitor 154 connected to lead 156, serves as a quenching capacitor to assist in preventing possible noise pick-up or oscillation of the timers 142 and 118.

The encoder 34 (See FIG. 1) produces a coded combination of signals identifying the zone in which the detector receiving sound above a predetermined level is located and feeds the combination of signals to the transmitter for modulation on a carrier signal and transmission. In this connection, the timing signals generated at the outputs of timers 118 and 142 are fed to the encoder 34 along predetermined electrical paths to generate the coded combination of signals for calling a predetermined receiver. More specifically, a first tone, i.e. "tone 1" is generated by the encoder 34 responsive to feeding the output of timer 118 into the transmitter control cable 138 through lead 132 which is connected to cable 138 through diode 135 and lead 133. A further tone, i.e., "tone 2", is generated by the encoder 34 responsive to feeding the output of timer 142 into cable 138 through lead 137.

In a similar manner, the output of timer 118' of channel 14' is fed to encoder 34 for the generation of "tone 1" through lead 132' which is connected to cable 138 through diode 135' and lead 133. To differentiate between the channels to the end that the coded combination of signals generated responsive to the detection of an alarm condition in the zone of detector 16' calls receiver 46', the output of timer 142' is fed to encoder 34 to produce a still further tone, i.e., tone 3. In this connection, the output of timer 142' is fed to cable 138 through leads 139 and 141. It will be recognized that additional channels may be added to produce preselected combinations of signals for uniquely identifying the zone of each detector for purposes of producing alert signals resulting in dispatching security personnel to the zone of an alarm condition. Moreover, a plurality of receivers can be called responsive to the generation of an alarm signal by one channel by wiring the timing circuits and encoder for the production of identical signals at the output of the encoder.

The duration of each of the timing signals generated at the outputs of the timers 118 and 142 are set at a value sufficient to activate the operatively associated receiver.

It will be recognized that timers 118 and 142 comprise a sequential timing circuit, i.e., timer 118 times out and at the completion of its timing out period it triggers timer or generator 142. In order to assist in preventing further alarm signals generated at the output of the discriminator 24 from interfering with operation of the timing circuit such as would be occasioned by the rapid occurrence of alarm conditions, means are provided for inhibiting timer 118 during the timing out period of timer 142. In this connection, a logic high signal is applied at the input of the timer 118, i.e., the "tone 1" timing generator through feedback path 148 including serially connected resistor 150 and diode 152 to prevent retriggering of timer 118 during the timing out period of timer 142. Thus, inhibiting timer 118 during the timing out period of timer 142 assists in assuring that the timing windows or signals developed by the timing circuit 26 and fed to the encoder 34 will result in calling the appropriate remote receiver.

In the embodiment shown in FIGS. 2A and 2B, the transmitter 40 (See FIG. 1) is actuated by a command signal generated by the timing means 26 responsive to the occurrence of an alarm condition. In this connection, the outputs of timers 118 and 142 are independently steered to transmitter 40 through leads **132*a* and 132*b*. As shown in FIG. 2B, leads 132*a* and 132*b* are connected through steering diodes 134*a* and 134*b*, respectively, and to lead 33 of the transmitter control cable 138. These diodes 134*a* and 134*b* serve to prevent feedback in the cable 138** from interfering with the circuit operation.

In order to continuously monitor the protected zone within which the alarm condition occurs, the audio system 56 is connected to the output of the preamplifier 18 by lead 160 (see FIGS. 2A and 2B). In the preferred embodiment, when timer 142 starts its timing sequence, its output triggers the latch **54*a* comprising silicon controlled rectifier (SCR) 162 through lead 161 which in turn energizes the coil indicated generally at 164 to connect the terminals 166 and 168 of switch 60 for passing the audio signal into the audio system 56 including the audio amplifier 55. In the illustrated embodiment, the audio signal connected to the audio system 56 passes through resistor 170 and blocking capacitor 172 and a variable resistor 174 which serves to adjust the audio level of the system 56. Speaker 58 is connected to the output of the audio amplifier 55** for purposes of converting the electric signals generated at the amplifier output into audio signals.

As necessary or desired, the sound generator 64 may be substituted for the audio amplifier 55 as in locations prohibiting monitoring audio from the protected zones by connecting the generator 64 to the latches 54 as shown on FIG. 1.

Responsive to the SCR 162 being triggered at the beginning of the timing sequence of timer 142, current is supplied through lead 176 connected to ground through resistor 178 and lamp 52 comprising LED 180 which illuminates to provide security personnel stationed at the control panel with an indication of the occurrence of an alarm condition. Upon completion of the monitoring operation, the audio system 56 and lamp 52 can be returned to their respective quiescent modes by operation of switch 53.

In a specific system constructed in accordance with the illustrated embodiment, components were used having the following values: power supply 88 = 12 volts, capacitors 78 and 78' = 0.1 microfarads; resistors 80 and 80' = 2,200 ohms; resistors 82 and 82' = 100,000 ohms, resistors 86 and 86' = 1 million ohms; resistors 94 and 94' = 46,000 ohms; capacitors 96 and 96' = 1 microfarad; resistors 98 and 98' = 10,000 ohms; capacitors 100 and 100' = 1 microfarad; resistors 108 and 108' = 100,000 ohms; resistors 110 and 110' = 1 million ohms; resistors 114 and 114' = 1 million ohms; capacitors 120 and 120' = 0.1 microfarad; capacitors 130 and 130' = 0.01 microfarads; resistors 128 and 128' = 10,000 ohms; resistors 150 and 150' = 1,000 ohms; resistors 124 and 124' = 1 million ohms; capacitors 126 and 126' = 1 microfarad; capacitors 140 and 140' = 0.1 microfarads; capacitors 154 and 154' = 0.1 microfarad; resistor 144 and 144' = 1 million ohms, capacitors 146 and 146' = 1 microfarads; resistors 170 and 170' = 10,000 ohms; resistor 174 = 100 ohms; capacitors 172 and 172' = 0.1 microfarads; resistors 200 and 200' = 10,000 ohms; resistors 202 and 202' = 10 ohms, capacitors 204 and 204' = 220 microfarads; capacitor 206 = 100 microfarads; resistor 208 = 47 ohms; capacitor 250 = 0.001 microfarads; resistor 248 = 1,000 ohms; capacitor 252 = 1 microfarads; capacitor 256 = 220 microfarads, resistors 258 and 258' = 1,500 ohms; resistors 260 and 260' = 1,000 ohms; and resistors 262 and 262' = 1,000 ohms. The power supply 88 is connected to the leads terminating in +V as indicated.

From the foregoing detailed description it will be recognized that the present method and apparatus for monitoring protected zones has certain advantages over the prior art. For example, the illustrated system automatically alerts the security personnel stationed at locations remote to the protected zones of the occurrence of an alarm condition. Moreover, the security personnel carrying the remote receivers are advised of the location of the alarm condition and are dispatched immediately to the location for purposes of taking remedial action. Concurrently, supervisory personnel stationed at the control panel are alerted to the occurrence of an alarm condition and an audio system positioned at the control panel is energized automatically in the preferred embodiment for continuously monitoring the protected zone within which the alarm condition occurs for purposes of making a positive verification of the nature of the alarm condition. In this connection, supervisory personnel may be advised of the nature of the alarm condition to the end that appropriate remedial action can be taken. To this end, a communication path is provided between personnel at the control panel and personnel carrying receivers. The communication path assists in enhancing the efficiency of the security staff such as by reducing the time during which personnel are absent from their assigned stations by aborting investigation of false alarms, for example.

While a preferred embodiment has been shown and described, it will be understood that there is no intention to limit the invention by such disclosure, but rather it is intended to cover all modifications and alternate constructions falling within the spirit and scope of the invention as defined in the appended claims and equivalence thereof.

What is claimed is:

1. A system for monitoring the sound level in a plurality of protected zones for notifying security personnel of the location of a zone in which the sound level exceeds a predetermined value indicative of an alarm condition, comprising:

detector means associated with each of said zones for detecting sound and producing electrical signals proportional to said sound that is detected;

discriminating means operably connected to each of said detector means for receiving said signals and generating an alarm signal in response to said signals exceeding a predetermined level;

timing circuit means connected to said discriminating means for producing predetermined timing signals which identify a zone from which an alarm signal is being generated by said discriminating means in response to receiving said alarm signal;

annunciator means having latch means connected to said timing circuit means, said annunciator means further including visual indicator means, speaker means for reproducing the sound detected by said detector means and switching means connected to said speaker means, said latch means energizing said visual indicator means subsequent to the generation of said timing signals, said latch means operating said switching means so that the switching means normally disables said speaker means and enables the same in response to said timing circuit means receiving said alarm signal;

encoder means connected to said timing circuit means for generating a coded combination of signals identifying the zone from which an alarm signal is being received;

transmitter means connected to said encoder means for modulating said coded combination signals on a carrier signal and transmitting said carrier signal and said coded combination of signals;

one or more receivers, each of which is respectively tuned to receive at least one of said coded combination of signals modulated on said carrier signal and transmitted by said transmitter means, each of said receivers receiving indicator means responsive to said transmitted signal for producing an alerting signal to alert security personnel of the occurrence of an alarm condition.

2. The system as defined in claim 1, wherein said indicator means comprises a plurality of zone lamps, each of said zone lamps being operably associated with one of said detectors and actuated responsive to the generation of an alarm signal indicative of sound exceeding a predetermined level in the zone in which said operatively associated detector is located.

3. The system as defined in claim 1, wherein said local annunciator means includes an alert system comprising a sound generator which generates a tone responsive to the generation of an alarm signal.

4. The system as defined in claim 1 wherein said timing circuit means generates a signal for actuating said transmitter means.

5. The system as defined in claim 1 wherein said timing circuit means includes a first timer connected to said means for discriminating among said electric signals, a further timer connected to said first timer, and means for inhibiting said first timer whereby said first timer is inhibited during a timing out period of said further timer.

6. The system as defined in claim 1 wherein said transmitter is adapted for modulating audio signals on said carrier signal, and each of said receivers is adapted for receiving said carrier signal with said audio signals modulated thereon, and including microphone means located at said annunciator means connected to said transmitter means for producing said audio signals, whereby a communication path is provided between said microphone means and each of said receivers enabling personnel stationed at said local annunciator system to provide security personnel alerted by one of said receivers with information pertinent to the type of remedial action, if any, advisable.

7. A system for monitoring the sound level in a plurality of protected zones for notifying security personnel of the location of a zone in which the sound level exceeds a predetermined value indicative of an alarm condition, comprising:

detector means associated with each of said zones for detecting sound and producing electrical signals proportional to said sound that is detected;

discriminating means operably connected to each of said detector means for receiving said signals and generating an alarm signal in response to said signals exceeding a predetermined level;

timing circuit means connected to said discriminating means for producing predetermined timing signals which identify a zone from which an alarm signal is being generated by said discriminating means in response to receiving said alarm signal;

annunciator means operatively connected to said detector means and to said timing circuit means, said annunciator means including visual indicator means actuated by said timing circuit means, said annunciator means including speaker means for reproducing the sound detected by said detector means, switching means connected to said speaker means and latch means for controlling said switching means so that said switching means normally disables said speaker means and enables the same in response to said timing circuit means producing said timing signals subsequent to receiving an alarm signal from said discriminating means;

means associated with said discriminating means for generating and transmitting signals identifying a zone in response to an alarm signal being generated by the discriminating means associated with said zone; and one or more receivers for selectively receiving said transmitted signals to provide an alerting signal for alerting security personnel of the occurrence of an alarm condition.

8. A method of monitoring protected zones, comprising the steps of:

detecting sound occurring in said zones by sonic detectors associated therewith;

converting sound into electrical signals having a power level that is proportional to the intensity of the detected sound;

monitoring the power level thereof and producing an alarm signal in the event the level exceeds a predetermined value;

producing a coded signal identifying the zone from which an alarm signal originates when such occurs;

transmitting a preselected coded combination of signals identifying the zone on a carrier signal adapted to be received by a remote receiver in response to an alarm condition;

enabling speaker means at a remote annunciator station subsequently of said coded identifying signal being produced for reproducing the detected sound only in the event an alarm condition occurs to thereby preclude the listening by personnel of the zones in the absence of an alarm condition.

9. The method as defined in claim 8 including the steps of:

producing a further alert signal at a control panel indicative of the zone within which sound received by one of said detectors exceeds a predetermined level, and continuously monitoring the sound received by said one of said detectors responsive to the production of said alarm signal whereby additional information regarding the nature of the alarm condition can be gathered by personnel stationed at said control panel to assist in determining what, if any, remedial action is advisable.

10. The method as defined in claim 9 including the step of personnel stationed at said control panel communicating with security personnel alerted by any of said receivers regarding additional information gathered by continuously monitoring the zone within which the sound exceeded a predetermined level whereby personnel stationed at said control panel can provide said security personnel alerted by said receiver with information pertinent to the type of remedial action, if any, is advisable.

* * * * *